US009205901B2

(12) United States Patent
Barrero López et al.

(10) Patent No.: US 9,205,901 B2
(45) Date of Patent: Dec. 8, 2015

(54) AQUATIC LIFESAVING DEVICE

(71) Applicant: Patentes Cala Cerrasa, S. L., Seville (ES)

(72) Inventors: Antonio Javier Barrero López, Seville (ES); Jose Alberto Barrero López, Seville (ES); Ivan García Arenilla, Tomeres (ES); Florencio Barrero López, Seville (ES)

(73) Assignee: Patentes Cala Cerrada, S.L., Seville (ES)

( * ) Notice: Subject to any disclaimer, the term of this patent is extended or adjusted under 35 U.S.C. 154(b) by 0 days.

(21) Appl. No.: 14/236,094

(22) PCT Filed: Feb. 21, 2013

(86) PCT No.: PCT/ES2013/000042
§ 371 (c)(1),
(2) Date: Jan. 30, 2014

(87) PCT Pub. No.: WO2013/128045
PCT Pub. Date: Sep. 6, 2013

(65) Prior Publication Data

US 2014/0154936 A1 Jun. 5, 2014

(30) Foreign Application Priority Data

Mar. 1, 2012 (ES) ..... 201200204

(51) Int. Cl.

| | |
|---|---|
| ***B63C 9/26*** | (2006.01) |
| ***B66D 1/02*** | (2006.01) |
| ***B66D 1/04*** | (2006.01) |
| *B63C 9/11* | (2006.01) |

(52) U.S. Cl.
CPC ... *B63C 9/26* (2013.01); *B66D 1/02* (2013.01); *B66D 1/04* (2013.01); *B63C 9/11* (2013.01)

(58) Field of Classification Search
CPC ..... B63C 9/26; B63C 9/08; B63C 9/11; B63C 1/04; B63C 1/02
USPC ..... 441/80, 83, 84, 88, 89
See application file for complete search history.

(56) References Cited

U.S. PATENT DOCUMENTS 5,326,297 A * 7/1994 Loughlin ..... 441/89
8,419,490 B1 * 4/2013 Eason ..... 441/89

* cited by examiner

*Primary Examiner* — Daniel V Venne

(57) ABSTRACT

This device comprises an iron casing closed with a glass door to be broken in the case of an emergency, within which is located, above a bench a motor that drives a shaft in rotation, on which is mounted a reel winding a rope attached to a life jacket that fits on the rescuer body, provided with a whistle. The end of the reel shaft bearings rests on a supporting tripod at the end of the bench and, on the outer side, has a coupling in order to mount a crank for winding by hand in the case of engine failure. A pole is anchored along the beach, the end thereof having a snap hook of the quick opening type, through which the rescuer passes the rope before entering the water.

12 Claims, 3 Drawing Sheets

AQUATIC LIFESAVING DEVICE

OBJECT OF THE INVENTION

The present invention relates to a device designed for helping people who have to rescue a person at risk of drowning, its main objective being to save the life of both the person providing the assistance and the assisted person.

The problem it seeks to solve is that, considering that a quarter of the world's coastline are beaches for public use, and that, as an example, only in Spain, over a hundred people drowned died last year in the months of July and August. In Galicia, drowning is the leading cause of accidental death. The Autonomous Community with more drowning victims was Murcia, with 23 deaths, followed by Galicia, with 17 deaths, and the Balearic Islands and Valencia, both with 16 dead persons. From Red Cross information, it may be reminded that the aquatic environment involves an "inherent risk" for everyone because the physiology of the human being "is not adapted to water".

Two types of rescue, maritime and aquatic are distinguished. The first one comprises the rescues that are performed at sea on persons who suffer a shipwreck, falling from a boat and including the persons drifting on their boats. Instead, the aquatic rescue refers to lifesavings that are made to beaches, rivers and swamps, depends more directly from the municipalities.

The present invention relates to aquatic rescue and lifesaving, and aims to save lives through an effective device for helping people who are at risk of drowning at beaches, rivers and swamps.

The proposed invention solves the problem of those rescuers who, being expert swimmers at sea, equipped only with a small hand floater, are ready to give their lives for the people who are in danger, and to whom it is relatively easy to reach the person they want to help; said problem arises when these rescuers have to take the victim out of the water in the case of strong undertow, where they are sometimes not strong enough, so both the injured person and the rescuer die drowning eventually.

Normally this type of rescues occur on days when there is a red flag and bathing is forbidden so there is rarely any people in the water, but only those being unaware, that have usually to be helped. Maybe in the days when there is green or yellow flag, an expert rescuer will not need to use the present device, but, in the case where there is no rescuer, this device can be used by any citizen and will not only be essential but also providing a greater assurance of successful return. There are other causes of risks in bathing such as cramps, fainting, infarcts, digestion outages that also need the help of someone giving assistance to swimmers in distress, and the present invention provides saving success for cases where there are no professional rescuers.

It also should be mentioned that the present invention is to be used because of its simplicity and safety of use, by anyone being not a professional rescuer, throughout the year, such rescuers being only employed by municipalities during the months of July and August. The rest of the year, there are no lifeguards on the beach, only first-aid stations. In this way, anyone can help a person in need, because the speed of action determines the success of saving a life.

The advantages over the prior art are quick and effective lifeguard action, this being immediately available to everyone. Winding the rope by the engine or hand winching ensures that both the rescuer and the rescued person, especially on days with strong undertow, or in cases of serious incidents such as those mentioned above.

The industrial application of the present invention is in the industry of lifesaving devices, in particular devices and mechanisms for aquatic rescue.

BACKGROUND OF THE INVENTION

To solve this problem of aquatic rescue avoiding risks for the rescuers, rescue floaters are known, and this is a system that has many detractors, as they are usually released with a rope, but its weight makes it difficult to handle, so their use has been ruled out systematically on the beaches, although it remains a useful tool in swimming pools. And there is nothing for those who are not professional rescuers.

Most municipalities have safety devices on its beaches, these being watchtowers, jet skis, aid stations, boats, ambulances, constituting a lifesaving service for about nine hours a day in summer months, including professional rescuers. In addition, there are many cases where anonymous people are trying to save someone in danger of drowning, a rescuer or qualified person being not present, and sometimes the rescuer also drowns, and also cases where, once the person to be rescued has been reached, it is impossible for the rescuer to see how to get out of the water. And this is why the Red Cross reminds that aquatic medium represents "an inherent risk" for everyone because the physiology of the human being "is not adapted to the water", rescue thus ending in many times in tragedy dying of the bather and the rescuer. Drowning while trying to leave the water and panic itself are the main causes of these deaths. Accordingly, an optimal lifesaving system must be designed to help both the person who helps to get out of the water and the rescued person, in the shortest time possible and with the lower risk.

A rescue system is also known, in which a winch with steel wire hook is used from a helicopter. This same type of rescue is used to help someone who is in a well, a mine, etc., and also for towing boats or remove vehicles from snow or mud. The proposed invention passes through the conjunction of this system whose functioning is much contrasted, and the expertise and preparation of the body of rescuers, and, this being perhaps even more important, the proposed invention can be used to successfully allow a person who is not qualified to rescue a third person in water. The drawback is that it takes too much time to go to the point of rescue.

In this sense, the patent ES 2 107 767 T3 8 relates to a floating stretcher intended for the recovery of injured persons at sea, of the type comprising a metal frame manipulated by a helicopter carrying a board of composite material ensuring the buoyancy of the assembly, the latter being hinged in the middle portion, in order that the assembly can be folded over on itself lengthwise.

Document ES 1 034 890 U relates to a device for saving people in water, constituted by a rigid body of a non-porous material having a lesser density than water, of a generally tapered configuration, provided with a peripheral ring surrounding the body, solidly joined to the body by a connecting portion at one end, by two first bridge forming portions in the middle of the body and two second bridge forming portions on either side of the opposite ends, at least one recess being also provided on body in which is removably disposed a case containing a mask to perform rescue breathing. Devices as described in patent ES 2 192 147 A1 are also known, dedicated for rescuing people in water environments, and tracking devices for rescue work as proposed by the utility model ES 1 008 342 U.

However, no lifesaving device identical or similar to the one proposed by the present invention is known, designed especially for rescues with the problem of undertow and other causes on the generally dangerous beaches for both bather and rescuer or anyone who spontaneously jump into the water to save the bather in danger, easy to use, with quick handling, low cost, and low maintenance but extraordinarily effective for this type of rescue.

DESCRIPTION OF THE INVENTION

The lifesaving device on beaches being the object of the present invention has the purpose of, in the case of an emergency of a possible drowning on beaches, rivers and swamps, allowing an intervening qualified or not qualified person to come to rescue with the tranquillity of being insured by a buoyancy element linked to the mainland by a rope and that the rescue system will pull both him and the rescued person safely, taking him from the current and shortening the time for action, that are so critical for saving a life.

The system is formed of a housing of iron, metal or hard plastic or other materials anchored to a concrete base, closed by a glass door to be broken in case of emergency. Inside the housing, a motor, preferably electric, is fixed on a bench and connected to the mains or to a battery, although in different embodiments it can be a combustion engine. This motor drives the rotation of a shaft on which is mounted a reel winding a rope of braided polypropylene or other reflective material, of at least 200 m in length and 10 mm in thickness, capable of floating in water and to withstand a weight of at least 1000 kg. The end of the rope wound on the reel is attached to the dorsal region of a lifejacket that the rescuer or the person performing rescue fits on his body, with strap between the legs, designed to keep an unconscious person face up and respiratory tract out of the water, the jacket being provided with a whistle to signal the moment when you can be rescued and a light signal. The end of said reel shaft rests on bearings mounted on a tripod support at the end of the bench and, on the outer end, has a link in order to be coupled to a crank for winding by hand in case of engine failure. In a different embodiment, the motor is connected to the reel shaft by means of a speed reducing pulley.

For better lifting of the rope, a pole fixed along the beach has, at the end thereof, a quick opening snap hook, through which the rescuer passes the rope before entering the water. This post is made of galvanized steel or other material, is about one meter and half high above the ground level, and is painted with the regulatory signalling stripes. The snap hook is of the automatic opening type, so the rope has simply to be passed through it. The post with the snap hook has a dual function, firstly preventing people from stumbling on the rope or on obstacles on the beach, and secondly to raise the point of recovery, which will allow the rescued person and the rescuer to keep the head high.

In a different embodiment, a lifejacket harness is provided.

In another alternative embodiment, an audible alarm is activated by breaking the glass door and the housing lights.

In another embodiment, upon breaking the glass door, an alarm signal is transmitted to the first aid center, in order to send an ambulance to the place of the incident.

The use of the rescue device object of this invention begins by opening the glass door of the housing, by breaking the glass, at which moment the housing lights, an audible alarm sounds and a message is sent to the first aid center to send an ambulance. Then, the rescuer or the person intending to perform the action to rescue the victim puts the life jacket on and ties the straps to the legs, leaving the end of the rope attached to the rescuer's back. Then, if there is a post, he runs to the post along the water and passes the rope through the snap hook and then swim to the person whom he is going to help. The rescuer secures the person to help to the jacket and blows the whistle or activates the light signal. At the rescue device, a person starts the motor winding the rope in the reel, pulling the rescuer and the rescued person until both reach the beach. If the engine does not work, the reel crank is actuated manually, for the same purpose.

BRIEF DESCRIPTION OF THE DRAWINGS

For a better understanding of this specification, some drawings are attached, which, by way of non-limiting example, describe a preferred embodiment of the invention, and in which.

Figure 1:
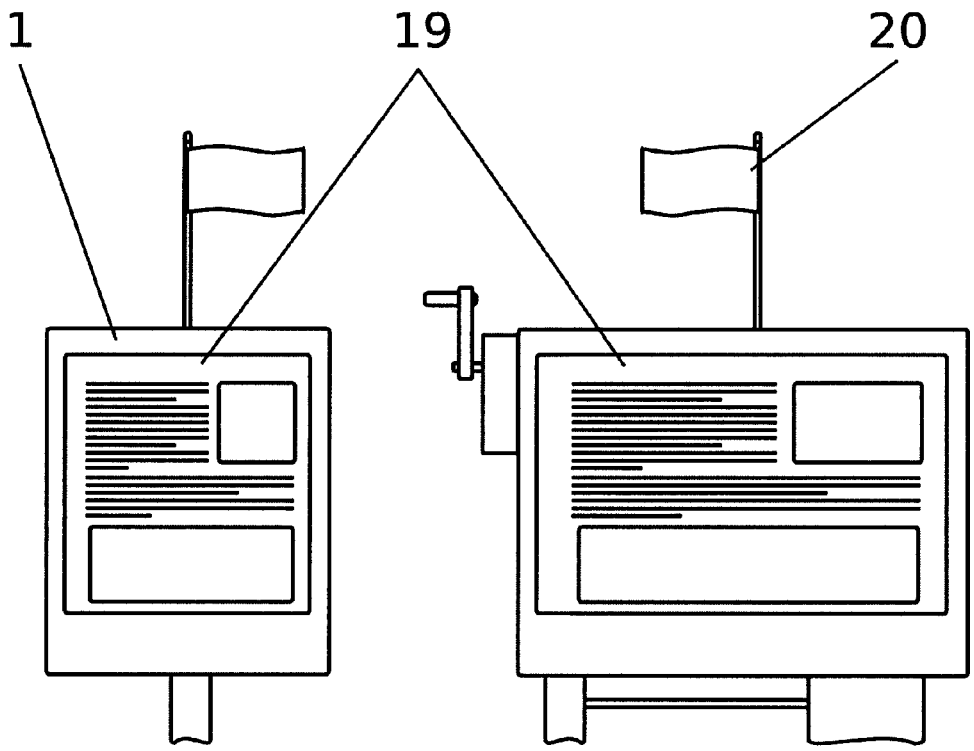
FIG. 1: side and rear elevation view of the housing.
Figure 2:
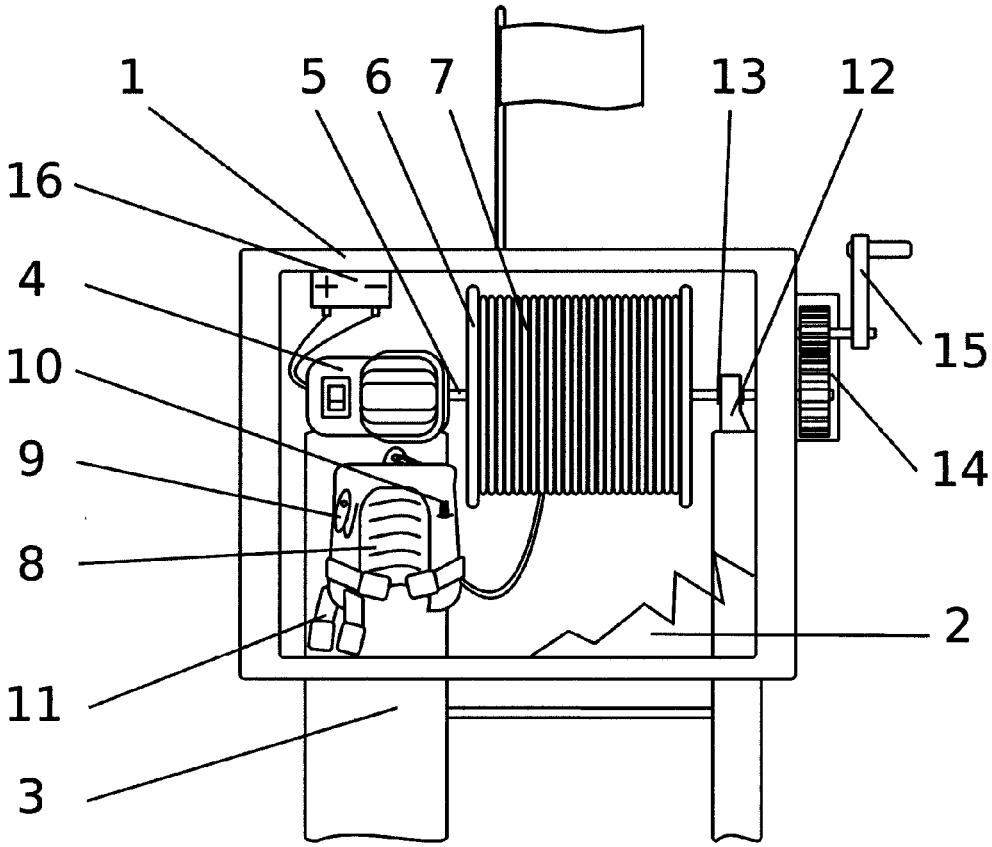
FIG. 2: bench with motor, reel, jacket, tripod, and coupling for a crank.
Figure 3:
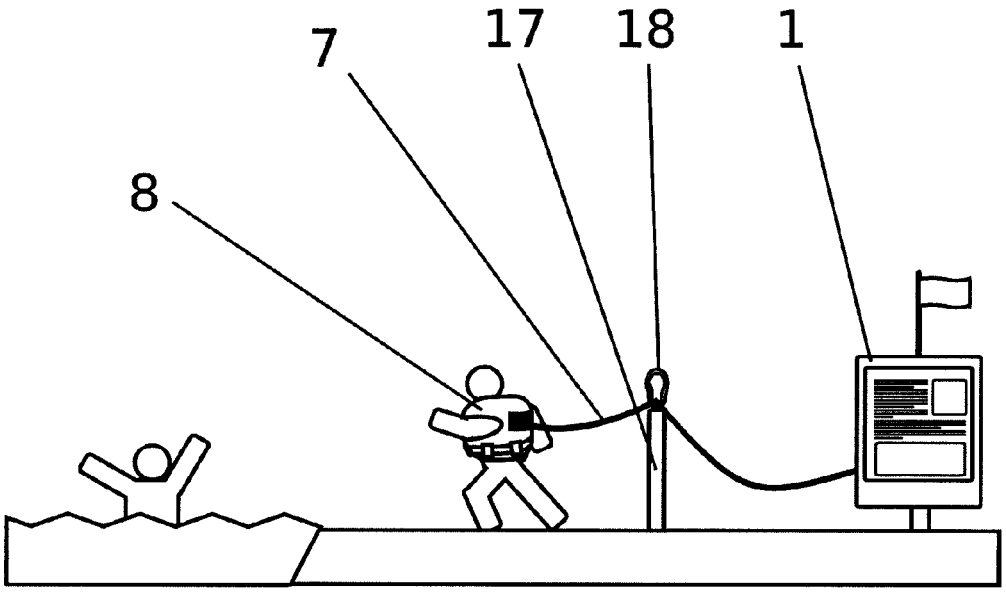
FIG. 3: conventional perspective view of the use of the pole.

In these Figures, the following numbered items are used:

1. Housing
2. Glass door
3. Bench
4. Engine
5. Axis
6. Reel
7. Rope
8. Lifejacket
9. Whistle
10. Light alarm
11. Auxiliary belt
12. Tripod on which the shaft bears
13. Bearings
14. Coupling for the crank
15. Crank
16. Battery
17. Post
18. Snap hook
19. Text and graphics
20. Identifier element

DESCRIPTION OF A PREFERRED EMBODIMENT

A preferred embodiment of the proposed invention includes a housing (1) of iron, metal or hard plastic anchored to a concrete base, closed by a glass door (2) to be broken in case of emergency. Inside the housing (1), is located, above the bench (3), a motor (4), preferably electric, is connected to mains or to a battery (16), although in different embodiments it can be a combustion engine. Said motor (4) drives the rotation of a shaft (5) on which is mounted a reel (6) winding a rope (7) of braided polypropylene or another reflective material, of at least 200 m long and 10 mm thick, capable of floating on water and to support a weight of at least 1000 kg. The end of the rope (7) reeled on the reel (6) is attached to the dorsal region of a life jacket (8) which the rescuer fits on his body, with a strap between the legs, provided with a whistle (9) and a light signal (10) to alert about the moment when he can be rescued, and also has an auxiliary belt (11) to fasten the rescued person. The end of said shaft (5) of the reel (6) rests on bearings (13) on a supporting tripod (12) at the end of the bench (3) and has at the outer side a coupling (14) to a crank (15) for the purpose of winding by hand in case of engine failure.

For better lifting of the rope (7), a post (17), anchored to the edge of the beach, has a snap hook (18) the end thereof, of the quick opening type, through which the rescuer passes the rope before entering the water. This post (17) is made of galvanized steel, or other material, has about one meter and half high, and is painted with the regulatory signalling stripes. The snap hook (18) is of the automatically opening type. The post (17) with snap hook (18) has a dual function, firstly preventing people from stumbling on the rope (7) or on obstacles on the beach, and secondly raising the point of recovery, which will allow rescuers and rescued persons to maintain the head high.

On the outside of the housing are incorporated graphic elements (19) with description about its use, as well as an identifier element (20) on its top for easy location.

The invention claimed is:

1. A rescue device for rescue in water, comprising an anchored housing, closed by a door to be broken in case of emergency, inside the housing, is located a motor, said motor driving a shaft on which is mounted a reel winding a rope, an end of the rope attached to a dorsal region of a life jacket, the life jacket being provided with a whistle and light signal.

2. The rescue device according to claim 1, wherein the shaft rests on bearings carried on a support.

3. The rescue device according to claim 1, further comprising a crank coupled to the shaft for manual operation.

4. The rescue device according to claim 1, further comprising a post carrying a snap hook at an end thereof.

5. The rescue device according to claim 1, wherein the life jacket is fitted with a harness.

6. The rescue device according to claim 1, wherein the motor is connected to the reel shaft by a speed reducing pulley.

7. The rescue device according to claim 4, wherein the snap hook is maintained at least 1.5 meters above ground level.

8. The rescue device according to claim 1, further comprising a battery or an electrical main connected to the motor.

9. The rescue device according to claim 1, wherein the rope is reflective.

10. The rescue device according to claim 1, wherein the rope is at least 200 m long and 10 mm thick.

11. The rescue device according to claim 1, wherein the life jacket further includes an auxiliary belt.

12. A rescue device comprising an anchored housing, the housing closed by a glass door, inside the housing is located a motor or combustion engine adapted to drive a shaft on which is mounted a winding of rope, the rope attached to a life jacket, the motor or combustion engine further adapted to pull a wearer of the life jacket back toward the rescue device.

* * * * *